United States Patent [19]

Madden et al.

[11] 4,323,818

[45] Apr. 6, 1982

[54] GETTER CONSTRUCTION FOR REDUCING THE ARC DISCHARGE CURRENT IN COLOR TV TUBES

[75] Inventors: Thomas H. Madden, Euclid; Clair W. Reash, Fairview Park, both of Ohio

[73] Assignee: Union Carbide Corporation, New York, N.Y.

[21] Appl. No.: 232,960

[22] Filed: Feb. 9, 1981

Related U.S. Application Data

[63] Continuation of Ser. No. 967,355, Dec. 7, 1978.

[51] Int. Cl.[3] ..... H01J 29/94

[52] U.S. Cl. ..... 313/481

[58] Field of Search ..... 313/178, 481

[56] References Cited

U.S. PATENT DOCUMENTS

| | | | |
|---|---|---|---|
| 3,547,255 | 12/1970 | Kalbfus | 313/174 X |
| 3,558,961 | 1/1971 | Palsha | 313/174 |
| 3,558,962 | 1/1971 | Reash | 313/180 |
| 3,560,788 | 2/1971 | Reash | 313/174 |
| 3,816,788 | 6/1974 | Reash | 313/174 |
| 3,829,730 | 8/1974 | Reash et al. | 313/174 |
| 4,029,987 | 6/1977 | Zucchinelli | 313/481 X |
| 4,101,247 | 7/1978 | Pirota et al. | 313/481 X |
| 4,101,803 | 7/1978 | Retsky et al. | 315/3 |
| 4,182,974 | 1/1980 | Ijzeren | 313/481 |

FOREIGN PATENT DOCUMENTS

| | | |
|---|---|---|
| 2013036 | 9/1971 | Fed. Rep. of Germany . |
| 2721449 | 8/1977 | Fed. Rep. of Germany . |

OTHER PUBLICATIONS

Philips Technical Note-039 (citation unknown).

*Primary Examiner*—Robert Segal

*Attorney, Agent, or Firm*—Frederick J. McCarthy

[57] ABSTRACT

Getter assembly for television picture tubes which minimizes arcing currents in a television picture tube.

1 Claim, 7 Drawing Figures

GETTER CONSTRUCTION FOR REDUCING THE ARC DISCHARGE CURRENT IN COLOR TV TUBES

This application is a continuation of our prior U.S. application: Ser No. 967,355 filed 12/7/78.

The present invention is directed to a getter assembly for use in television picture tubes. More particularly the present invention is directed to a getter assembly which functions to minimize potentially destructive electrical arc currents in television picture tubes.

The problem of electrical arcs and arc currents in television picture tubes is well known and described in detail in the prior art, for example U.S. Pat. No. 4,101,803 (1978). As noted in this patent and elsewhere in the prior art, conductive coatings provided on the inside and outside of the funnel portion of television picture tubes consitute a large capacitor which filters the high voltage which is applied to the screen of the television picture tube. The inner conductive coating is at the same potential as the screen and transmits the screen voltage to the neck of the picture tube where it is applied, e.g., by spring contacts, to a high voltage anode electrode at the forward part of the electron gun. The various electrodes in the electron gun are closely spaced and at widely different electric potentials. This circumstance, as is well known, results in arcing between the electrodes in the event that foreign particulate matter occurs in an inter-electrode space or if there is an improperly spaced electrode. In the event of aan arc, the filter capacitor formed by the conductive coatings on the inside and outside portions of the picture tube funnel dumps its enormous stored charge within a few microseconds resulting in instantaneous currents on the order of hundreds of amperes and higher which can cause destruction of associated circuitry.

A known technique for reducing the magntiude of the arc currents is to employ a resistive coating on the inner surface of the picture tube funnel, e.g., composition containing metal oxide, e.g., iron oxide. The resistivity of such coatings is relatively high, on the order of 2,000 to 6,000 ohms per square, and the arc current can be reduced on that account. However, in the gettering of television picture tubes, as is known to the art, a film of barium metal is deposited on portions of the inner funnel surface overlying the resistive coating and, at times, can provide a low resistance path and essentially short circuit the resistive coating.

It is accordingly an object of the present invention to provide a getter assembly which avoids the deposition of a short circuit barium film.

Figure 1:
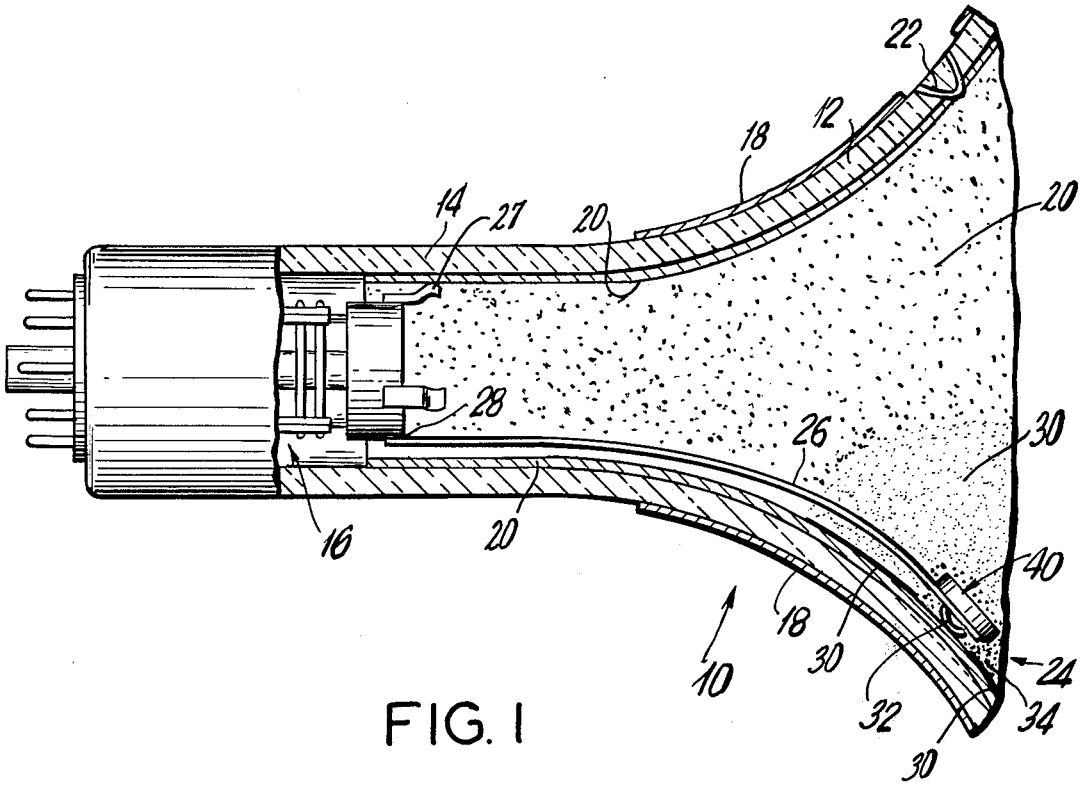
Figure 3:
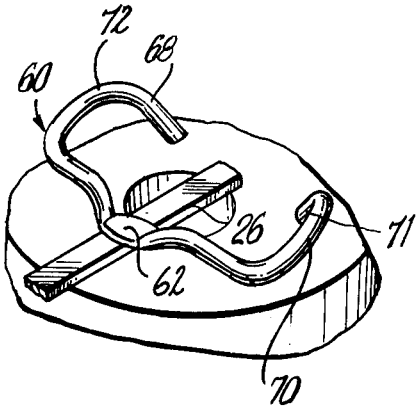
Figure 4:
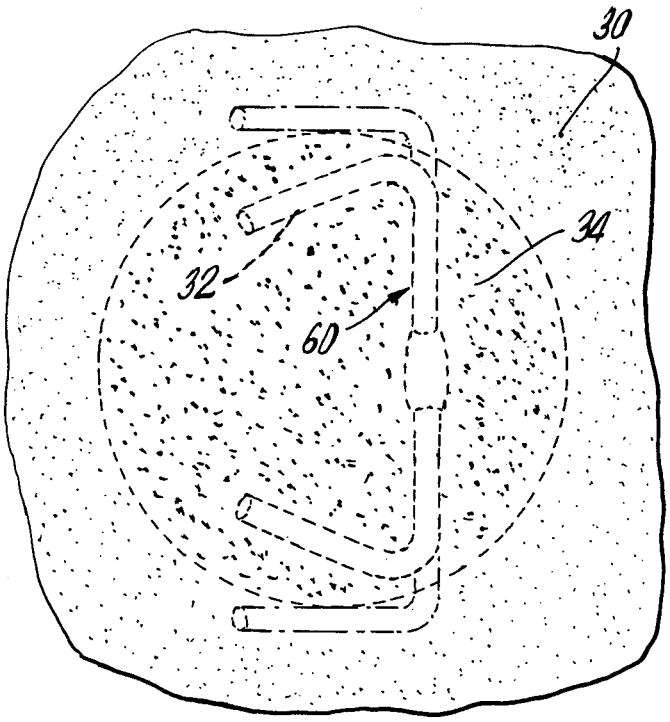
Figure 2A:
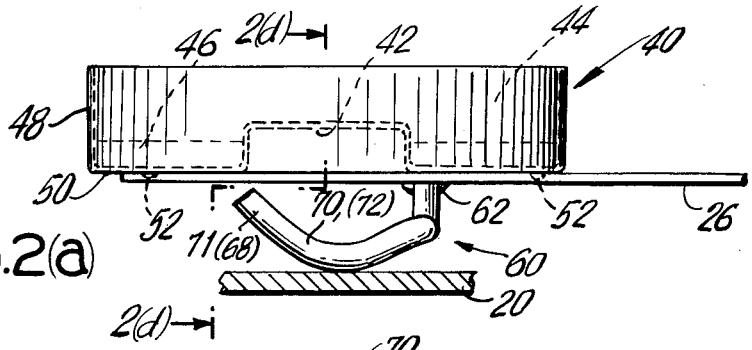
Figure 2B:
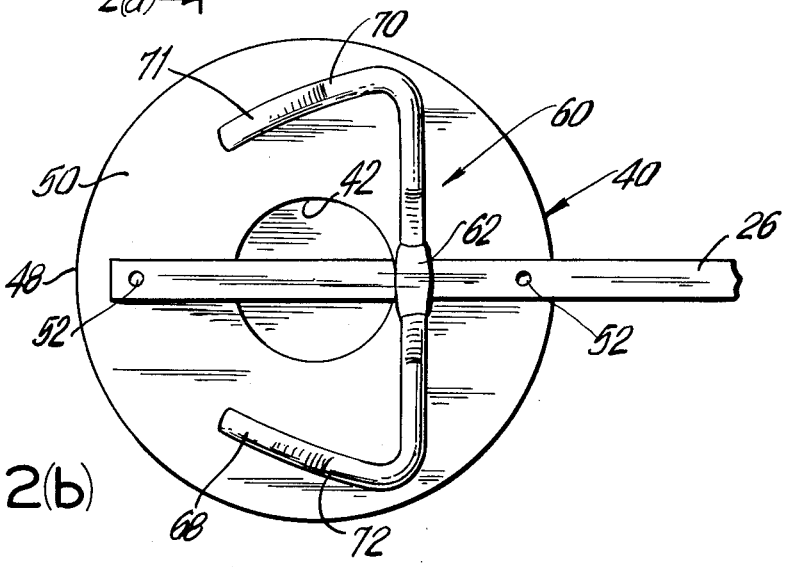
Figure 2C:
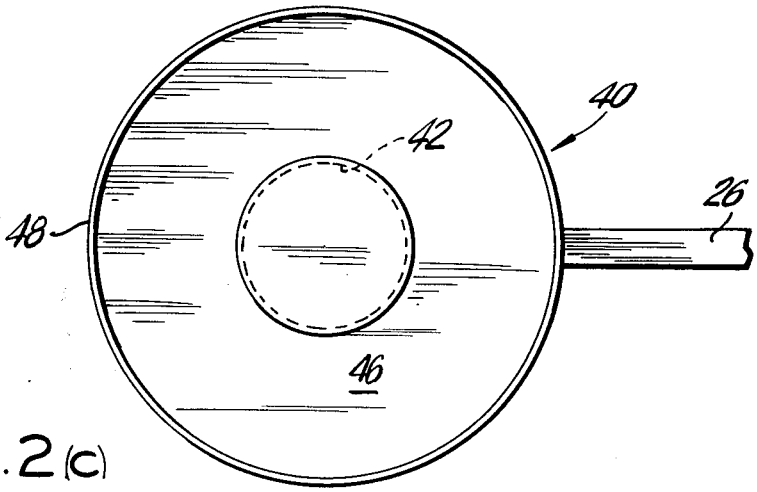
Figure 2D:
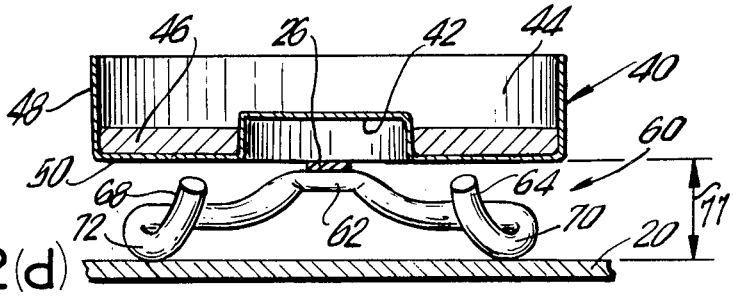

Other objects will be apparent from the following description and claims taken in conjunction with the drawing wherein FIG. 1 shows a television picture tube having a getter in accordance with the present invention incorporated therein FIGS. 2(*a*)–2(*d*) show representative elevation and plan views of the getter of the present invention FIG. 3 is a perspective view of the getter support member of the present invention, and FIG. 4 illustrates the distribution of getter material using a getter in accordance with the present invention.

With reference to FIG. 1 of the drawing, a television picture tube is indicated at 10 having a glass funnel portion 12 joined to neck 14. An electron gun assembly is schematically indicated at 16. An outer conductive coating is provided at 18 and a resistive inner conductive coating is provided at 20. A high voltage is conventionally applied to the resistive inner coating through anode button 22. The above-noted inner and outer coatings constitute a filter capacitor.

A getter assembly is provided as shown at 24 mounted on elongated metal spring member, or "antenna" 26 which is attached at 28 to electron gun 16 whereby a path is provided for the transmission of the high voltage on resistive coating 20 to the electron gun 16. This path is incidental to the main high voltage path which is via snubber spring contact 27. When the getter 24 of the present invention is "flashed" the vaporized getter material, e.g., barium, is deposited in the funnel portion 12 as indicated at 30 and bridges a portion of resistive coating 20. If this "bridging" coating of barium were to contact the support member 32 of getter assembly 24, a short circuit of resistive coating 20 would occur in the event of an arc condition. However, in the practice of the present invention as hereinafter more fully described, the barium film 30 is not deposited in the region 34 where the getter support member 32 contacts resistive coating 20.

With reference to FIGS. 2(*a*)–2(*d*) the getter assembly of the present invention comprises a cylindrical getter container or receptacle 40 suitably made of stainless steel having an upraised bottom portion 42 which forms an annular open top channel 44 in which is pressed getter material 46 in the usual manner, e.g., for example 1000 mg. of 25% Ba, 25% Al, 50% Ni exothermic alloy yielding about 225 mg. of Ba on "flashing". The side wall 48 which joins floor member 50 of channel 44 is substantially greater in height than upraised portion 42 with respect to floor member 50, e.g., 1.5 to 5 times greater in height, preferably about 2 times greater in height. Antenna mount 26 is joined to the floor member 50 by spot welds at 52. Wire support member 60, shown in perspective in FIG. 3, and with reference to FIGS. 2(*a*)–(*d*), comprises a length of small diameter, e.g., 0.045 inch wire having for convenience a flattened middle portion and having end portions 68, 71 both bent inwardly toward each other. These end portions are bent first downwardly and then upwardly to form curved bases 70, 72. The wire support member 60 is arranged perpendicularly to antenna support 26 and fastened at its flattened midpoint 62 by a spot weld. The wire support member 60 will thus depend downwardly from the bottom of metal receptacle 40 with the curved bases 70, 72 entirely beneath the floor member 50 and spaced inwardly from side wall member 48 toward the upraised portion 42, preferably about midway between the side wall member 48 and upraised portion 42. On account of the above-described configuration, upon "flashing" of getter material 46, the vaporized metal will not deposit in region 34 shown in FIGS. 1 and 4 due to the substantially higher side wall 48 and since region 34 is essentially "shadowed" against the getter material vapor by the flow member 50 of receptacle 40. Thus, the inwardly curved base portions 70, 72 rest in resistive region 34 spaced from getter metal film 30.

By way of specific example a getter assembly in accordance with the present invention was made with a container of 305 stainless steel having an outer diameter of 0.765 in. The height of the container sides was 0.165 in., the width of the getter channel floor was 0.238 and the height of the upraised center portion was 0.076 in. The wire support was formed of 0.045 in. diameter 305 stainless steel wire and held the floor of the getter container 0.155 in. from the inner surface of the picture tube when installed. Getter material (25% Ba, 25% Al, 50% Ni) in the amount of 1,000 mg. was pressed in the channel of the getter.

Using getters of the above type in accordance with the present invention arc current was reduced in tests to about 60 amperes from about 600 amperes which resulted when getters were used which did not have the combination of high side walls and "shadowed" support member.

In some applications, the height 77 of wire support member 60 is reduced so that the bottom of receptacle 40 is closer than usual (0.155 inch) to the funnel portion of the picture tube, e.g., about (0.130 to 0.150 inch), in order to enchance the "shadowing" effect.

What is claimed is:

1. A getter assembly for a cathode ray tube having a funnel portion with a high resistance coating thereon of the order of 2,000 to 6,000 ohms per square to reduce arc current magnitude, said getter assembly being directly connected electrically to the electron gun of a cathode ray tube and comprising a cylindrically shaped metal receptacle having an open top; a side wall member; an upraised bottom portion which with said wall member defines in said receptacle an annular channel having a floor member, the height of said side wall member with respect to said floor member being about 2 times greater than the height of said upraised bottom portion; getter material within said annular channel; a wire support member depending from the bottom of said receptacle the ends of said wire support being bent inwardly toward each other, first downwardly and then upwardly to form two spaced apart curved bases for contacting the resistance coating on the funnel portion of said cathode ray tube, said curved bases being entirely located beneath said floor member and spaced inwardly from said side wall member toward said upraised portion and being located about 0.130 to 0.155 inch from said floor member whereby short circuiting of the resistive coating due to flashing of the getter is avoided.

* * * * *